United States Patent [19]

Brooks

[11] Patent Number: 4,481,960

[45] Date of Patent: Nov. 13, 1984

[54] CIGARETTES

[75] Inventor: Geoffrey O. Brooks, Southampton, Great Britain

[73] Assignee: British-American Tobacco Company Limited, London, England

[21] Appl. No.: 402,252

[22] Filed: Jul. 27, 1982

[30] Foreign Application Priority Data

Aug. 5, 1981 [GB] United Kingdom ..... 8123959

[51] Int. Cl.[3] ..... A24D 1/00; A24D 1/02

[52] U.S. Cl. ..... 131/336; 131/360; 131/365

[58] Field of Search ..... 131/336, 365, 360, 352, 131/353

[56] References Cited

U.S. PATENT DOCUMENTS 4,088,142 5/1978 Horsewell et al. ..... 131/336

4,225,636 9/1980 Cline et al. ..... 131/336

*Primary Examiner*—V. Millin

*Attorney, Agent, or Firm*—Kane, Dalsimer, Kane, Sullivan and Kurucz

[57] ABSTRACT

A smoking article which comprises a rod of smoking material contained within a wrapper has an air-permeability in a range of from 20 to about 120 Coresta units and is provided in the region of the mouth end, with ventilation means to give a degree of ventilation of 15 to 90%, the ratio of carbon-monoxide yield to tar yield of the smoking article being significantly less than 0.9. If the article has a tip means, the ventilation means may be provided, at least partially, in the tip means. The smoking material may include a high proportion of lamina-leaf tobacco having a relatively high nicotine content. Tobacco in the smoking material, possibly including stem tobacco, is coarsely cut or shredded. The smoking material may include up to 60% of expanded tobacco. The wrapper may contain an addition of a burn-promoting agent.

8 Claims, 1 Drawing Figure

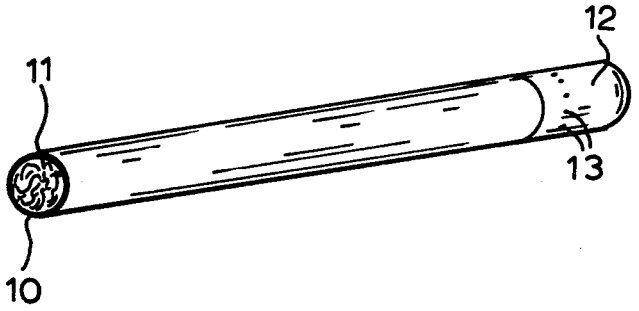
12
11
13
10

CIGARETTES

BACKGROUND OF THE INVENTION

1. Field of the Invention

The present invention relates to smoking articles, for example and particularly, but not exclusively cigarettes.

2. Brief Description of the Prior Art

The ratio of the weight of carbon monoxide to the weight of tar delivered in the mainstream smoke of cigarettes is usually unity or more, although in some cases the ratio is as low as 0.9. By "tar" is meant particulate material measured on a water and nicotine-free basis. It has now been discovered that, if a novel configuration of cigarette-design features is observed, it is possible to obtain significantly lowered CO:tar delivery ratios. Moreover by use of the invention, low CO:tar ratios may be realised without incurring expense and manufacturing problems associated with the use of materials which have been proposed for removing carbon monoxide from cigarette smoke by chemical means.

SUMMARY OF THE INVENTION

The present invention provides a smoking article comprising a rod of smoking material enclosed or enwrapped in an envelope or wrapper hereinafter referred to simply as a wrapper, having an air permeability in a range of from 20 to about 120, preferably from 20 to 60, Coresta units, said smoking article being provided with ventilation means, advantageously in the region of the mouth or butt end of said smoking article to give a degree of ventilation in a range of from 15 to about 90%, preferably from 60 to about 80%, whereby the ratio of carbon monoxide yield to tar yield of said smoking article is significantly less than 0.9 and preferably not more than 0.5.

A cigarette according to the present invention may exhibit a CO:tar ratio as low as about 0.3, although conveniently the ratio lies within a range of from 0.5 to 0.75.

BRIEF DESCRIPTION OF THE DRAWING

The accompanying drawing is of an embodiment smoking article of the invention.

DETAILED DESCRIPTION OF THE PREFERRED EMBODIMENTS OF THE INVENTION

If the smoking article comprises a tip means, the ventilation provision may conveniently be in the tip means. A tip means, where used, may be a mouthpiece, a low-efficiency filter, or a flow-impedance device as disclosed in our co-pending United Kingdom Patent Application No. 80.14455. By a low efficiency filter we mean a filter having a filtration efficiency for tar of not more than 35%. For a conventional cellulose-acetate filter to have a filtration efficiency for tar not exceeding 35%, the pressure drop of the filter would not have to exceed about 50 mm water gauge.

If the smoking article does not comprise a filter or other tip means, the wrapper of the article must be such as to permit the ingress of ventilation air. Even if the smoking article does comprise tip means, the or a proportion of the ventilation air may flow through the wrapper of the smoking material rod. Segregated ventilation or ventilation through a tipping wrapper may be employed.

The smoking article shown in perspective view in the accompanying drawing is in the form of a cigaret comprising a rod smoking material 11 enveloped in a paper wrapper 10. This wrapper has a permeability for air in a range of 20 to approximately 120 Coresta units and is provided, in the region of tip means 12 at the mouth end, with ventilation perforations 13 giving a degree of ventilation of 15 to 90%. The ratio of carbon monoxide yield to tar yield of the smoking article is significantly less than 0.9. If the article has a tip means 12, the ventilation perforations 13 may be provided, at least partially, in the tip means.

The air permeability of smoking article wrappers is determined in Coresta units by measuring the amount of air in cubic centimeters which passes through a one square centimeter area of the wrapper material in one minute at a constant pressure difference of 1.0 kilopascal.

For any particular smoking article according to the present invention, it is possible to determine an optimum wrapper permeability value within the range of 20 to 120 Coresta units. Permeability values above or below the optimum value would result in higher CO:tar ratios.

Preferably the rod of smoking material comprises a high proportion, suitably 80–100%, of lamina leaf tobacco having a relatively high nicotine content, e.g. 2–5% on a dry-weight basis.

Advantageously tobacco in the rod is tobacco which is coarsely cut, that is to say cut in the order of thirty cuts per inch or less. If a proportion of stem is included, the stem should be coarsely cut or shredded.

The smoking material may conveniently contain up to about 50 to 60% of expanded tobacco.

Currently it is the expectation that the addition of burn-promoting agents, e.g. sodium citrate, to cigarette paper would result in an increased yield of carbon monoxide. However, in a cigarette in accordance with the present invention the addition of such agents at a low level has been found to result in a reduction in the carbon monoxide yield and thus also in an even lower CO:tar ratio.

The following are examples of ways of carrying out the invention:

EXAMPLE I

Cigarettes were made comprising tobacco rods 64 mm long wrapped in a cigarette paper of 45 Coresta units air permeability and provided with self-sustaining cellulose-acetate filters 20 mm long and having 70% ventilation by way of a ring of mechanically formed ventilation holes. The filler of smoking material was composed wholly of lamina tobacco, of which 30% by weight had been expanded. The filler tobacco was cut at 30 cuts per inch. The nicotine content of the filler was 2.6%. Sodium citrate was added to the cigarette paper at a 1% level. These cigarettes were smoked with 35 cc puffs of 2 seconds duration at one minute intervals to a tobacco butt length of 8 mm. It was determined that the yield of tar was 7.3 mg. The yields of nicotine and carbon monoxide were 1.0 mg and 1.9 mg respectively. Thus the CO:tar ratio was 0.26. The filtration efficiency for tar of the filters was determined to be 24%.

EXAMPLE II

Cigarettes of the same design as those of Example I, excepting that the cigarette paper had an air permebility of 42 Coresta units and the filters had a ventilation of 77%, were smoked according to the same regime as in Example I. The deliveries per cigarette of tar, nicotine and carbon monoxide were 5.1 mg, 0.8 mg and 1.5 mg. Thus the CO:tar ratio was 0.29.

EXAMPLE III

Cigarettes were made with differed from those of Example I in the following respect only: The cigarette paper was of an air permeability of 45 Coresta units and contained no sodium citrate or other burn-promoting agent. The level of filter ventilation was 74%. Of the all-lamina tobacco filler, 40% had been expanded. The deliveries per cigarette of tar, nicotine and carbon monoxide were 7.6 mg, 1.1 mg and 2.8 mg. Thus the CO:tar ratio was 0.37.

EXAMPLE IV

Cigarettes made as those of Example III, except for a 2% level of sodium citrate in the cigarette paper and the use of porous tippings, were found to have deliveries of tar, nicotine and carbon monoxide of 7.2 mg, 1.06 mg and 2.3 mg per cigarette. Thus the CO:tar ratio of these cigarettes was 0.32.

EXAMPLE V

Cigarettes were made comprising 64 mm long tobacco rods, wrapped in cigarette paper of 50 Coresta units air-permeability and wrapped cellulose acetate filters 20 mm long which were laser perforated on-machine to provide an 18% ventilation level. The filler was composed of 80% selected lamina and 20% mixed flue-cured stem, the lamina and stem having been cut at 30 and 150 cuts per inch respectively. The filler nicotine content was 2.0%. Sodium citrate was added to the cigarette paper at a 0.8% level. The cigarettes were smoked according to the regime of Example I. The tar yield per cigarette was 17.0 mg. The yields of nicotine and carbon monoxide were 1.43 mg and 12.4 respectively. Thus the CO:tar ratio was 0.73. The filtration efficiency for tar of the filters was determined to be 34%.

What is claimed is:

1. A smoking article which comprises a rod of smoking material contained within a wrapper having an air-permeability within a range of from 20 to about 120 Coresta units and is provided, in the region of the mouth end of the article, with ventilation means to give a degree of ventilation of 15 to 90%, the ratio of carbon monoxide yield to tar yield of the smoking article being less than 0.9.

2. A smoking article according to claim 1, wherein the said air permeability is within the range of 20 to 60 Coresta units, the degree of ventilation within the range of 60 to 80%, and the ratio of carbon monoxide yield to tar yield within the range of 0.5 to 0.75.

3. A smoking article according to claim 1 or 2 and provided with a tip means, the ventilation means being provided, at least partially, in the tip means.

4. A smoking article according to claim 1 or 2, wherein the smoking material comprises a high proportion of lamina-leaf tobacco having a relatively high nicotine content.

5. A smoking article according to claim 1 or 2, wherein the smoking material comprises coarsely cut or shredded tobacco.

6. A smoking article according to claim 1 or 2, wherein the smoking material comprises coarsely cut or shredded tobacco stem.

7. A smoking article according to claim 1 or 2, wherein the smoking material comprises up to 60% of expanded tobacco.

8. A smoking article according to claim 1 or 2 and provided with a wrapper comprising an addition of a burn-promoting agent.

* * * * *